US010889434B2

(12) United States Patent
Mandelbaum

(10) Patent No.: US 10,889,434 B2
(45) Date of Patent: Jan. 12, 2021

(54) ATTACHABLE BAG DISPENSER

(71) Applicant: Binyomin Mandelbaum, Howell, NJ (US)

(72) Inventor: Binyomin Mandelbaum, Howell, NJ (US)

( * ) Notice: Subject to any disclaimer, the term of this patent is extended or adjusted under 35 U.S.C. 154(b) by 449 days.

(21) Appl. No.: 15/615,931

(22) Filed: Jun. 7, 2017

(65) Prior Publication Data

US 2018/0354716 A1 Dec. 13, 2018

(51) Int. Cl.

| | |
|---|---|
| ***B65F 1/06*** | (2006.01) |
| ***B65D 83/08*** | (2006.01) |
| ***B65D 33/00*** | (2006.01) |

(52) U.S. Cl.

CPC ..... *B65F 1/062* (2013.01); *B65D 33/002* (2013.01); *B65D 83/0805* (2013.01); *B65D 83/0894* (2013.01); *B65F 1/067* (2013.01); *B65D 2313/00* (2013.01)

(58) Field of Classification Search

CPC ..... B65F 1/062; B65F 1/067; B65D 33/002; B65D 33/008; B65D 83/0805; B65D 83/0894

See application file for complete search history.

(56) References Cited

U.S. PATENT DOCUMENTS

| | | | | |
|---|---|---|---|---|
| 4,721,226 | A * | 1/1988 | Yurko | B65F 1/062 220/495.07 |
| 4,995,530 | A * | 2/1991 | Tabor | B65D 83/08 221/281 |
| 5,000,340 | A | 3/1991 | Leggio | |
| 5,115,935 | A | 5/1992 | Lemongelli | |
| 5,353,950 | A | 10/1994 | Taylor et al. | |
| 5,671,847 | A | 9/1997 | Pederson et al. | |
| 6,193,095 | B1 * | 2/2001 | McNeil | B65F 1/062 220/495.07 |
| 7,168,591 | B1 * | 1/2007 | Miller | B65F 1/062 220/495.06 |
| 7,252,194 | B2 | 8/2007 | Tracy | |
| 8,104,657 | B2 | 1/2012 | Barella | |
| 2005/0092753 | A1 | 5/2005 | Best | |
| 2005/0258177 | A1 | 11/2005 | Woodson | |

* cited by examiner

*Primary Examiner* — Don M Anderson

(74) *Attorney, Agent, or Firm* — Weiss & Arons LLP

(57) ABSTRACT

A receptacle-liner dispenser for dispensing disposable liners is provided. The dispenser may include a liner holder including one or more walls. The one or more walls may preferably define an interior configured for storing the liners. The one or more walls may include a dispensing region configured for providing a passageway between the interior and an exterior of the holder. The dispenser may further include one or more tabs projecting exteriorly from the holder. The tabs may be configured to perform a releasable securing of the dispenser to a surface.

23 Claims, 8 Drawing Sheets

ATTACHABLE BAG DISPENSER

FIELD OF TECHNOLOGY

Aspects of the invention relate generally to dispensers. More specifically, the disclosure relates to bag dispensers.

BACKGROUND

Disposable bag dispensers are one of the more convenient apparatus available to the modern user. Individual bags are withdrawn from the dispenser and, for example, used to line a waste receptacle, such as a garbage can or waste basket. When the bag is full, it is removed from the receptacle and disposed of. A replacement bag is withdrawn from the dispenser and put in place of the dispensed bag.

Conventionally, the dispenser is located at a distance from the receptacle. The full bag must be removed from the receptacle and, separately, the replacement bag must be individually withdrawn from the dispenser, opened and inserted into, and appropriately arranged within and usually over the lip of, the receptacle.

Considering the frequency with which this process must be repeated in a modern home or office, the time and exertion expended can readily grow into a sizable inconvenience. Placing the dispenser near the receptacle may be impractical, —e.g., if there is no convenient storage location for the dispenser near the receptacle.

One possible solution might involve keeping the dispenser inside the receptacle itself. However, this solution may actually make replacing the bags even more inconvenient, for example, if a replacement bag needs to be reached down for manually at the bottom of the receptacle. Another possible solution of having the dispenser automatically dispense the replacement bag as the full bag is removed may be ineffective if the dispenser is not reliably secured at the bottom of the receptacle.

Therefore, it would be desirable to provide apparatus and methods for optimizing replacement of a disposable bag in a receptacle. It would further be desirable to provide apparatus and methods for reliably securing a dispenser at the bottom of the receptacle.

BRIEF DESCRIPTION OF THE DRAWINGS

The objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
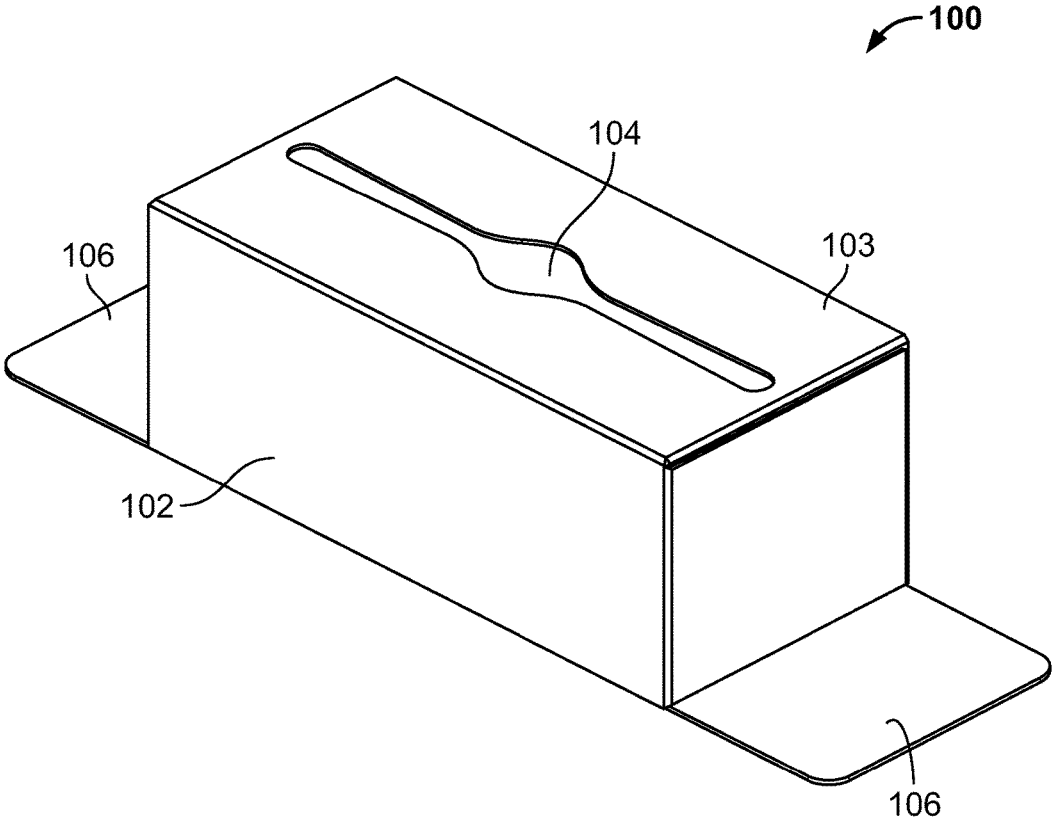
FIG. 1 shows a perspective view of apparatus in accordance with the principles of the invention.

Apparatus and methods are provided for optimizing replacement of a disposable bag in a receptacle. The apparatus and methods are provided in a configuration involving reliably securing a dispenser to the receptacle.

The apparatus may include, and the methods may involve, a dispenser. The dispenser may be configured for dispensing one or more dispensable items. The dispenser may include any dispenser suitable for dispensing the items. The dispenser may or may not at least partly contain the items.

The items may include one or more disposable or non-disposable items. The items may include one or more bags. The bags may include receptacle-liners for lining a receptacle. The receptacle-liners may include waste basket liners. The receptacle-liners may include hamper liners. The receptacle-liners may include garbage bags. The receptacle-liners may include recycling bags. The bags may include laundry bags. The dispenser may include a bag dispenser for dispensing the one or more bags. The dispenser may include a receptacle-liner dispenser for dispensing the one or more receptacle-liners.

Alternatively, or additionally, the items may include paper towels, napkins, toilet paper, tissues, wipes, toilet seat covers, disposable gloves, medical booties, surgical jumpsuits, and/or any other items suitable for dispensing from a dispenser. Any other suitable items may include exam table paper, tablecloths and/or easel paper.

The dispenser may include a holder. The dispenser may include a compartment. The holder may include the compartment. The compartment may include the holder. The holder may include one or more holder walls. The holder may be configured to receive, hold, store, carry and/or dispense the items. The holder may define an interior configured for storing the items. The one or more holder walls may define the interior. For example, a cylindrical wall may define the interior.

The holder may include the items. The holder may define an opening. The items may be serially dispensed from the holder via the opening. The items may be serially removed from the holder via the opening. The items may be connected to each other. The items may be serially connected to each other. The items may be connected to each other by one or more inter-item portions. The inter-item portions may be configured to disjoin in response to application of a force, so as to separate one of the items from the next. The inter-item portions may define perforations between serially adjoined items. Alternatively, or additionally, the items may be interleaved and/or serially folded one within another such that complete removal of one of the items from the dispenser causes at least a portion of a second of the items to emerge from the opening.

The holder may include a dispensing region configured for providing a passageway between the interior and an exterior of the holder. The dispensing region may include the opening. The opening may include a slot. The opening may include a hole. The opening may include a slit. The opening may be dimensioned to facilitate the dispensing. The dispensing may include sequential dispensing. The dispensing may include dispensing of the items from the interior via the dispensing region.

In a pre-dispensing state, the dispensing region may be configured to be torn open, thereby forming the opening. In the pre-dispensing state, the dispensing region may be configured to be cut open, thereby forming the opening. In a pre-dispensing state, the dispensing region may include perforations. The perforations may be defined within a material of one or more of the holder walls. The perforations may be configured to be opened, thereby forming the opening. The perforations may be configured to be opened, thereby forming the slot, slit and/or hole. The perforations may be configured to accommodate tearing a portion of the dispensing region to thereby form the opening.

The dispenser may include one or more tabs. The dispenser may include one or more wings. The tabs may include the wings. The wings may include the tabs. The tabs may be configured to perform a securing of the dispenser to one or more than one surface. The tabs may be configured to perform a releasable securing of the dispenser to the surface. The surface may include a surface of the receptacle. The receptacle may include the surface. The surface may include an interior surface of the receptacle. The surface may include an exterior surface of the receptacle. The tabs may be configured to facilitate installation of the dispenser to the surface. The installation may include the securing. The securing may include an attaching of the tabs to the surface. The securing may include a releasable attaching of the tabs to the surface.

The securing of the dispenser to the surface may include a sliding of one or more of the tabs into one or more than one recess. The receptacle may include the recess. The receptacle may define the recess. The recess(es) may be defined by the surface. One or more than one section of the receptacle may include the recess. The section of the receptacle may define the recess. The recess may be defined within the section of the receptacle. The section of the receptacle may include a bottom of the receptacle. The section of the receptacle may include a side of the receptacle. The section of the receptacle may include a top of the receptacle. The recess may be defined between a first part of the receptacle and a second part of the receptacle. For example, the recess may be defined between a cover of the receptacle and a rim of the receptacle.

The receptacle may be configured to receive the dispenser. The receptacle may be configured to hold the dispenser. The receptacle may be configured to secure the dispenser. The receptacle may be configured to receive, hold, and/or secure the tabs. The section may be configured to receive, hold, and/or secure the tabs. The recess(es) may be configured to receive, hold, and/or secure the tab(s). The section may include one or more retaining members. The retaining members may be configured to releasably hold the dispenser. The retaining members may define the recess. The retaining members may be configured to securely hold the tabs. The retaining members may include one or more than one clip configured to hold the tabs. The clip may define the recess(es). The retaining members may include one or more than one slot configured to hold the tabs. The slot may include the recess. The retaining members may include one or more than one elastic band retained about the receptacle. The band may define the recess(es).

The receptacle may be configured to collect articles. The articles may include waste. The articles may include laundry. The articles may include any articles suitable for collecting into the receptacle. The receptacle may include a hamper. The receptacle may include a recycle bin. The receptacle may include a wall-mounted dispenser-base for dispensing the items. The receptacle may include an end configured to receive the articles. The receptacle may include a top end configured to receive the articles. The receptacle may include an interior bottom end. The interior bottom end may include the retaining members.

The receptacle may include one or more than one woven portion. The section of the receptacle may include the one or more than one woven portion. The woven portion may include a wicker portion. The woven portion may include a rattan portion. The woven portion may define the recess(es). The securing may include a sliding of the tab(s) into the recess(es) defined by the woven portion. The recess may be at least partially defined by a weft. The recess may be at least partially defined by a warp. The securing may include sliding the tabs between one or more portions of the warp and one or more portions of the weft.

The tabs may project from the holder. The tabs may project exteriorly from the holder. The tabs may project from one or more sections of the holder. The tabs may project from one or more of the holder walls. The tabs may project from a section of the holder disposed opposite the dispensing region. The tabs may project from one or more holder walls disposed opposite the dispensing region. For example, a first wall defining the interior may include the dispensing region and the tabs may project from a second wall positioned opposite the first wall.

The dispenser may include an adhesive. The adhesive may be configured to adhere to the surface. The adhesive may be configured to releasably adhere to the surface. The holder walls may include the adhesive. The tabs may include the adhesive. The wings may include the adhesive. The adhesive may be disposed exteriorly to the holder walls. The adhesive may be disposed opposite the dispensing region. The adhesive may extend along the tabs. The adhesive may extend along a portion of the tabs. The securing of the dispenser to the surface may include an adhering with the adhesive. The securing may include an adhering of the dispenser to the surface via the adhesive.

The apparatus may include, and the methods may involve, a waste management kit for disposing of waste. The kit may include a one or more of the receptacle-liners. The liners may include disposable liners. The liners may be serially connected by one or more inter-liner portions. The portions may be configured to disjoin in response to application of a force, so as to separate one liner from the next. The kit may include the receptacle-liner dispenser. The dispenser may include the compartment. The compartment may be configured for storing the liners. The compartment may include the dispensing region. The dispensing region may be configured to accommodate dispensing the liners. The dispenser may include the one or more tabs. The tabs may project exteriorly from the compartment. The kit may include the receptacle.

Apparatus and methods in accordance with the invention will now be described in connection with the FIGS. The FIGS. show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

Apparatus and methods of the invention may involve some or all of the features of the illustrative apparatus and/or some or all of the steps of the illustrative methods. Illustrative embodiments will now be described with reference to the accompanying drawings, which form a part hereof.

The apparatus and methods of the invention will be described in connection with embodiments and features of illustrative devices. The devices will be described now with reference to the FIGS. It is to be understood that other embodiments may be utilized and structural, functional and procedural modifications may be made without departing from the scope and spirit of the present invention.

FIG. 1 shows exemplary bag dispenser 100. Bag dispenser 100 includes bag storage compartment 102. Bag storage compartment 102 includes top wall 103. Top wall 103 includes dispensing opening 104. Dispensing opening 104 may include narrow lateral ends configured to control a dispensing of bags (not shown) stored within storage compartment 102. Dispensing opening 104 may include a wide central portion configured to allow easy access to compartment 102 for a user withdrawing the bags from storage compartment 102.

Bag dispenser 100 includes lateral wings 106. Lateral wings 106 extend outwardly from a bottom wall (not shown) of compartment 102. Lateral wings 106 may be configured to extend into a recess defined within a surface of a receptacle (not shown). Lateral wings 106 may include adhesive (not shown) configured to releasably adhere to an inner surface of the receptacle.

Figure 2:
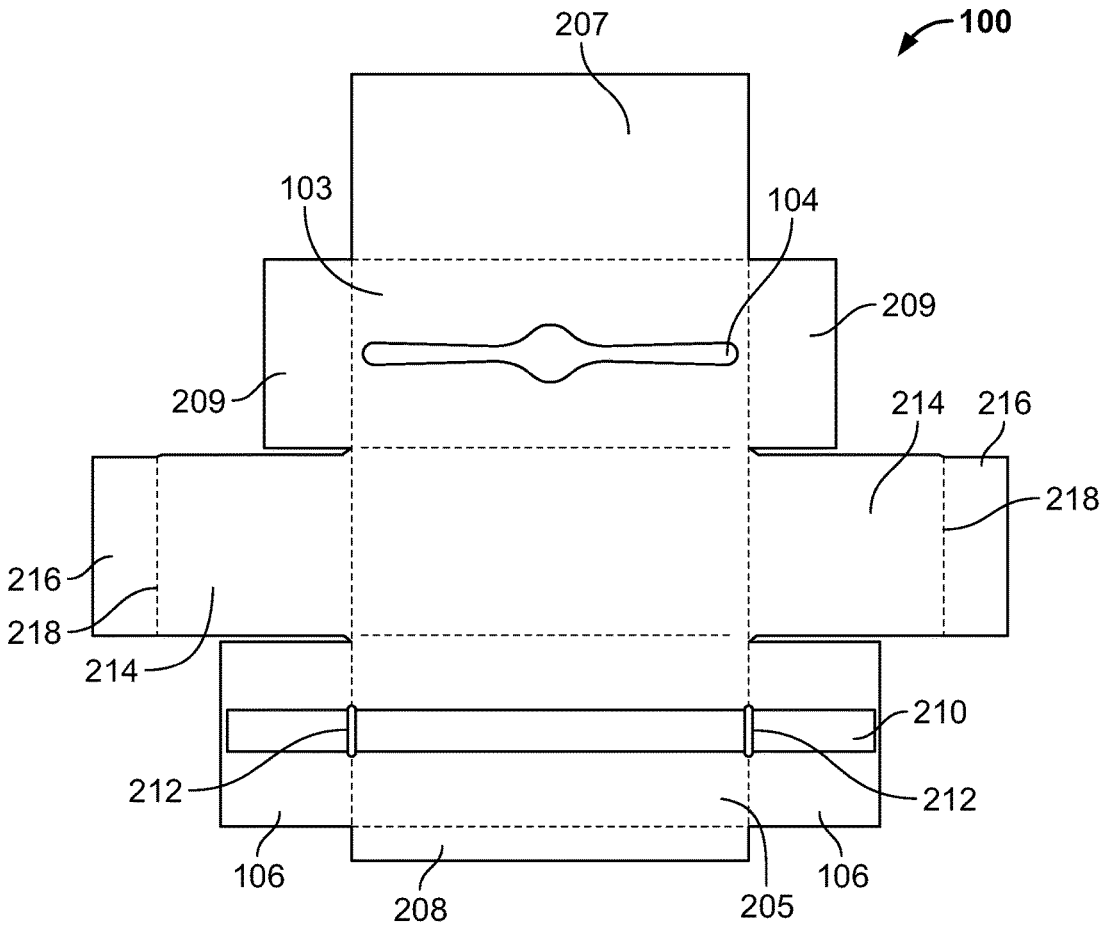
FIG. 2 shows a top plan view of unassembled apparatus in accordance with the principles of the invention.

FIG. 2 shows bag dispenser 100 in an unassembled state. Assembly of dispenser 100 may include folding dispenser 100 along one or more creases (—e.g. such as creases shown in FIG. 2 as dashed lines). Assembly of dispenser 100 may include adhering together one or more flaps. Assembly of dispenser 100 may include adhering flap 208 to an outermost edge of flap 207.

In the unassembled state, wings 106 may be configured to be folded under side closure flaps 214, in a first configuration of dispenser 100. Side flaps 209 may also be configured to be folded under side closure flaps 214. In the first configuration, wings 106 may be configured to be releasably held in place by side closure flaps 214. Side flaps 209 may also be configured to be releasably held in place by side closure flaps 214. The first configuration may promote stability and/or compactness during shipping and/or storage, prior to use. In a second configuration (shown in FIG. 1), wings 106 may be unfolded for installation into the receptacle (not shown). In the second configuration, side flaps 209 may be held in place by side closure flaps 214 to promote stability of dispenser 100 during use. Flaps 209 may be configured to engage frictionally with side closure flaps 214 during storage, shipping and/or use. The frictional engagement may promote stability of dispenser 100. The frictional engagement may prevent inadvertent disassembly of device 100. The frictional engagement may prevent an inadvertent dislodging of contents (not shown) from dispenser 100.

Folding of side closure flaps 214 upon creases 218 may form side closure tuck flaps 216. Side closure flaps 214 may be releasably held in place by side closure tuck flaps 216. Side closure tuck flaps 216 may be releasably held in place by friction upon insertion into a cavity formed by the adhering of flap 208 to the outermost edge of flap 207.

Adhesive 210 may be bonded to bottom wall 205. Adhesive 210 may be bonded to a bottom surface of wings 106. Adhesive 210 may include a release liner for removal by a user prior to installation into the receptacle. The liner may include perforations 212 configured to enable folding and/or unfolding of wings 106.

Figure 3A:
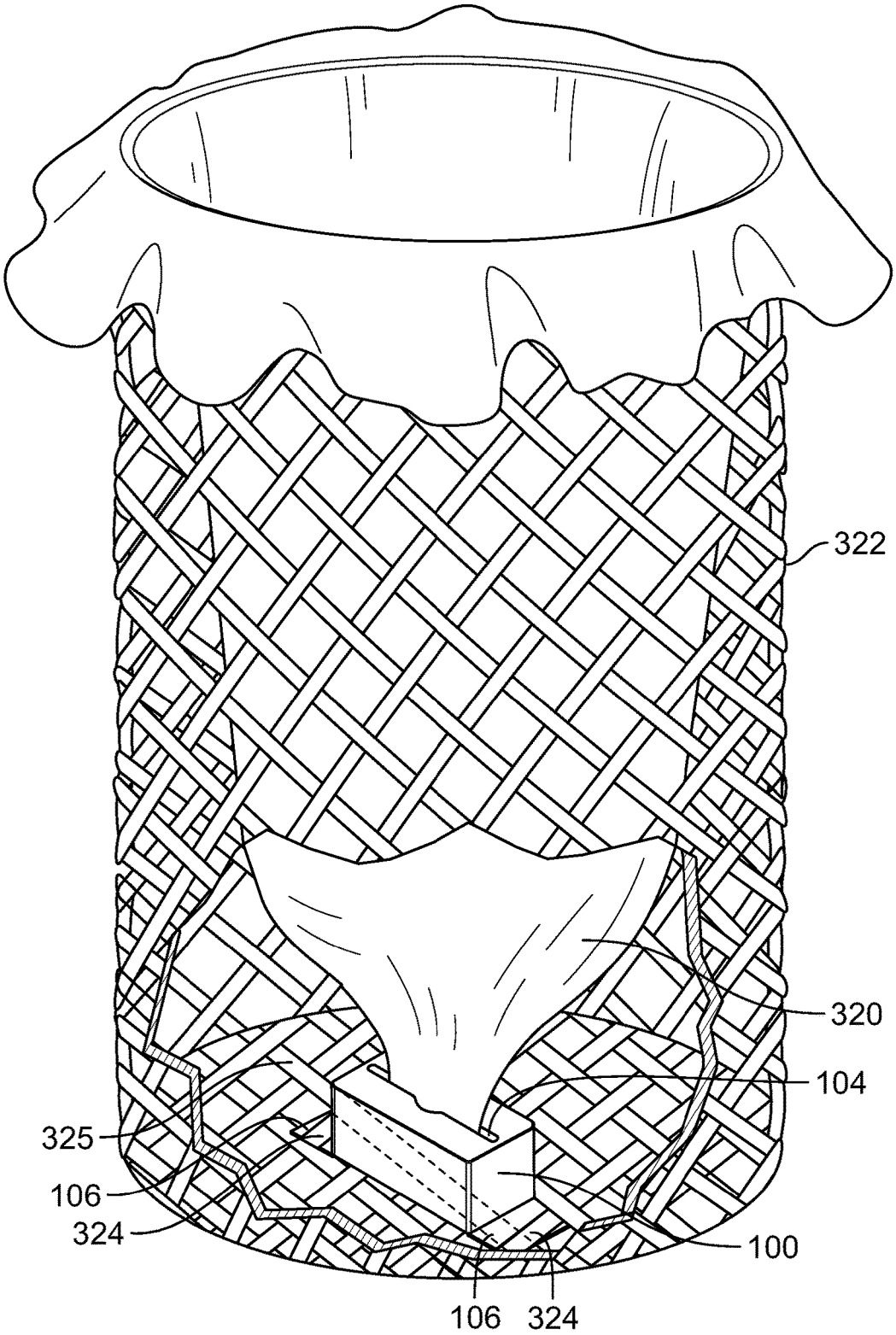
FIG. 3A shows a perspective view of apparatus in accordance with the principles of the invention, with a cutaway showing some features of the apparatus.

FIG. 3A shows dispenser 100 installed into exemplary woven receptacle 322. Flaps 106 are inserted between woven members 324 and woven member 325 of receptacle 322, thereby holding dispenser 100 securely, but releasably, in place. Adhesive (such as adhesive 210 shown in FIG. 2) on a surface of dispenser 100 may also releasably secure dispenser 100, —e.g., to woven member 325. Bag 320 is depicted as having been dispensed from opening 104 and arranged so as to line receptacle 322.

Figure 3B:
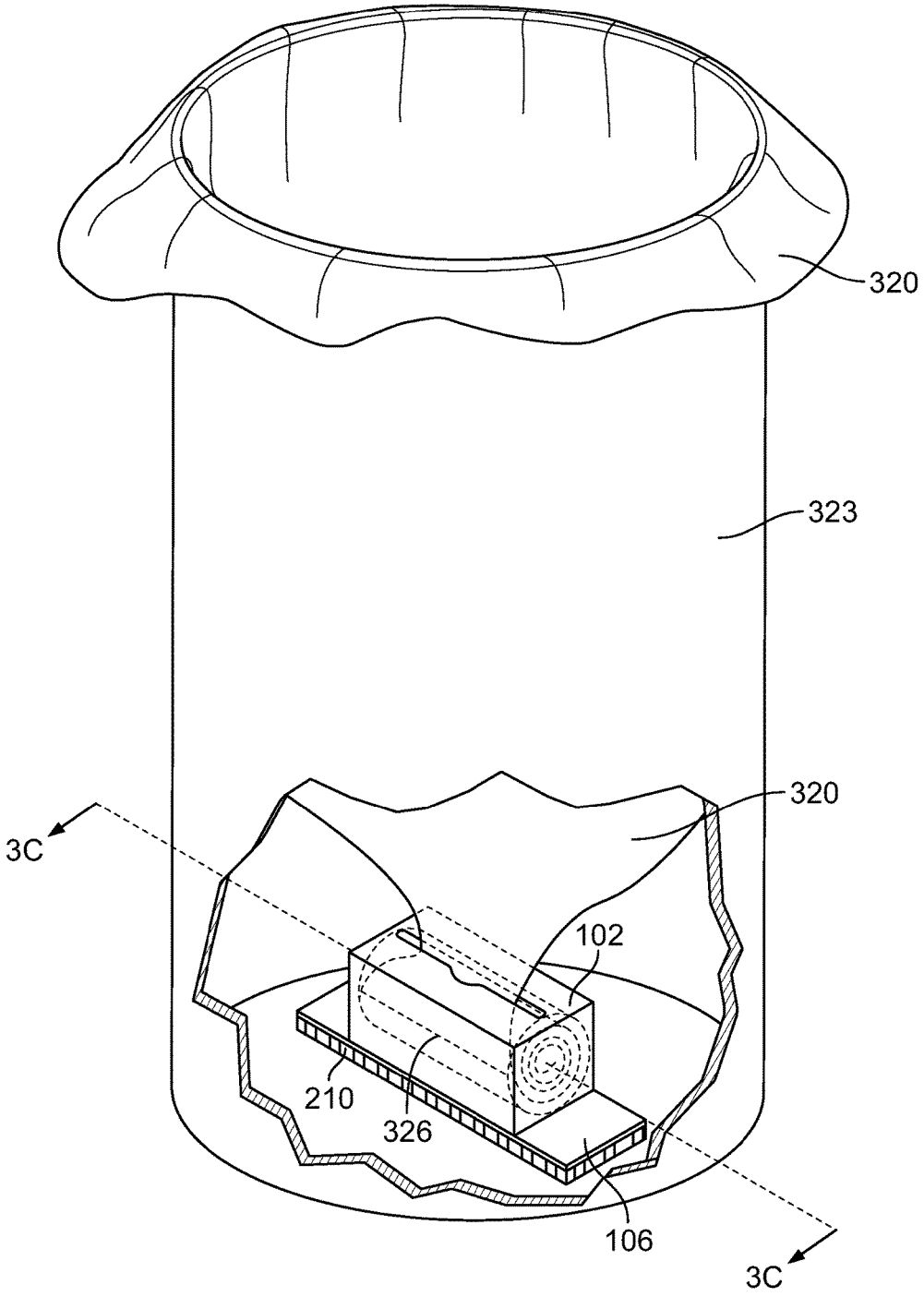
FIG. 3B shows a perspective view of apparatus in accordance with the principles of the invention, with a cutaway showing some features of the apparatus.
Figure 3C:
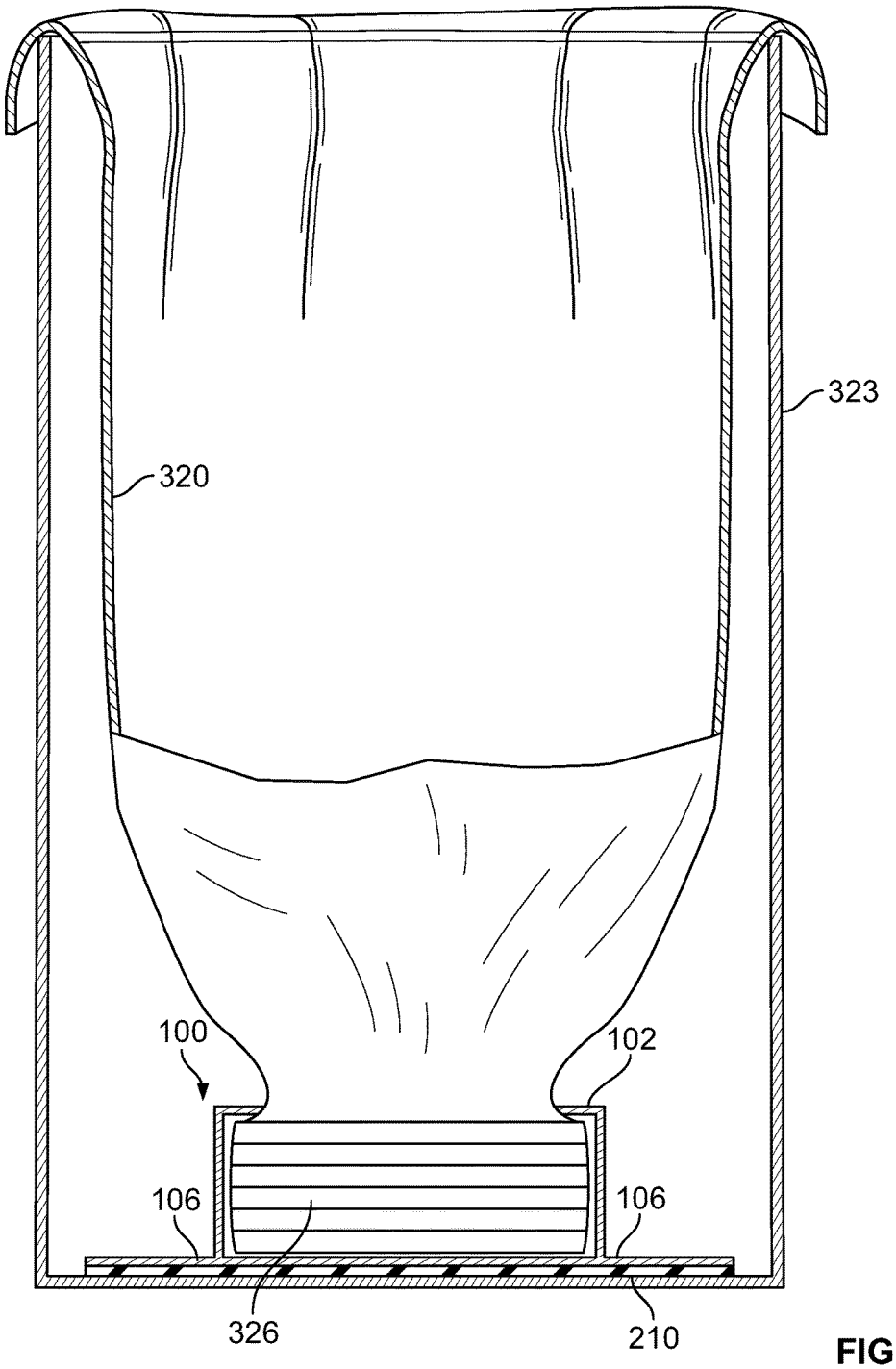
FIG. 3C shows a partial cross-sectional view of the apparatus shown in FIG. 3B, the view taken along lines 3C-3C (shown in FIG. 3B)

FIGS. 3B and 3C show dispenser 100 installed into exemplary receptacle 323. Adhesive 210 on a bottom surface of compartment 102 and/or on flaps 106 releasably secures dispenser 100 to receptacle 323. Bag 320 is depicted as having been dispensed from an opening in compartment 102 of dispenser 100 and arranged so as to line receptacle 323. Additional replacement bags 326 may form a roll (shown in phantom in FIG. 3B and in cross-section in FIG. 3C) are contained within receptacle 102. Once bag 320 is full, —e.g., of waste and/or laundry, bag 320 may be lifted up and out of upper opening of receptacle 323. As bag 320 is lifted up and out of receptacle 323, one of replacement bags 326, is automatically dragged upward toward the upper opening of receptacle 323 by a releasable connecting region between the one of the replacement bags and bag 320. Upon disconnecting the connecting region, —e.g., by tearing along perforations defined between adjacent bags, the one replacement bag may be easily opened and used to line receptacle 323.

Figure 4:
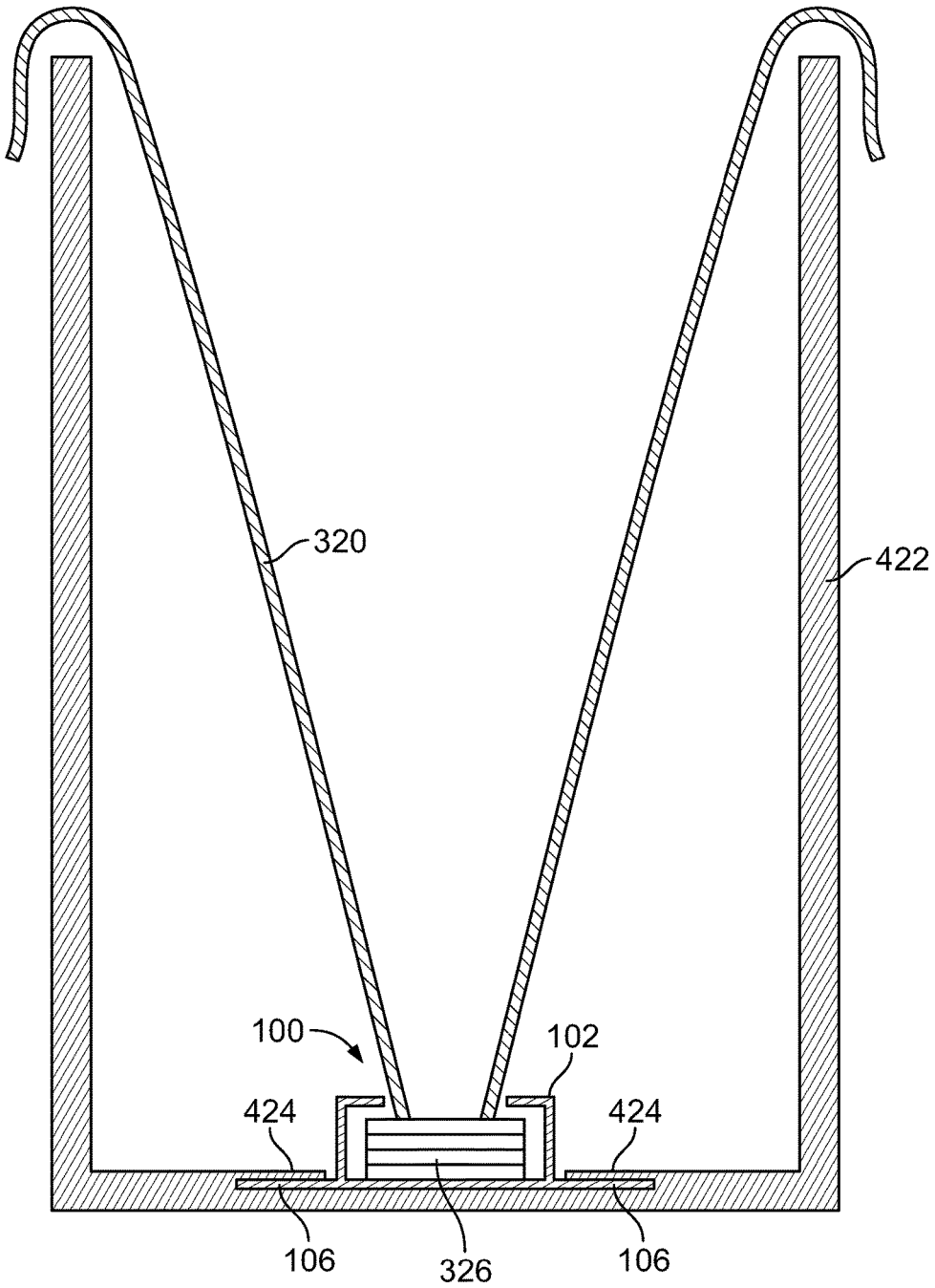
FIG. 4 shows a cross-sectional view of apparatus in accordance with the principles of the invention.

FIG. 4 shows dispenser 100 installed into receptacle 422. Flaps 106 are disposed in recesses defined by dispenser retaining members 424 of receptacle 422, thereby holding dispenser 100 securely, but releasably, in place. Retaining members 424 may define the recesses such that flaps 106 are held securely but releasably in place. Retaining members 424 may or may not include, —e.g., springs (not shown) configured such that flaps 106 are held securely but releasably in place. Adhesive (such as adhesive 210 shown in FIG. 2) on a surface of dispenser 100 may also releasably secure dispenser 100 to receptacle 422. Bag 320 is depicted as having been dispensed from an opening in compartment 102 of dispenser 100 and arranged so as to line receptacle 422. Remaining replacement bags 326, forming, —e.g., a roll, are contained within receptacle 102. Once bag 320 is full of, —e.g., waste and/or laundry, bag 320 may be lifted up and out of upper opening of receptacle 422. As bag 320 is lifted up and out of receptacle 422, one of replacement bags 326, is automatically dragged upward toward the upper opening of receptacle 422 by a releasable connecting region (not shown) between the one of the replacement bags and bag 320. Upon disconnecting the connecting region, —e.g. by tearing along perforations therein (not shown), the one replacement bag may be easily opened and used to line receptacle 422.

Figure 5:
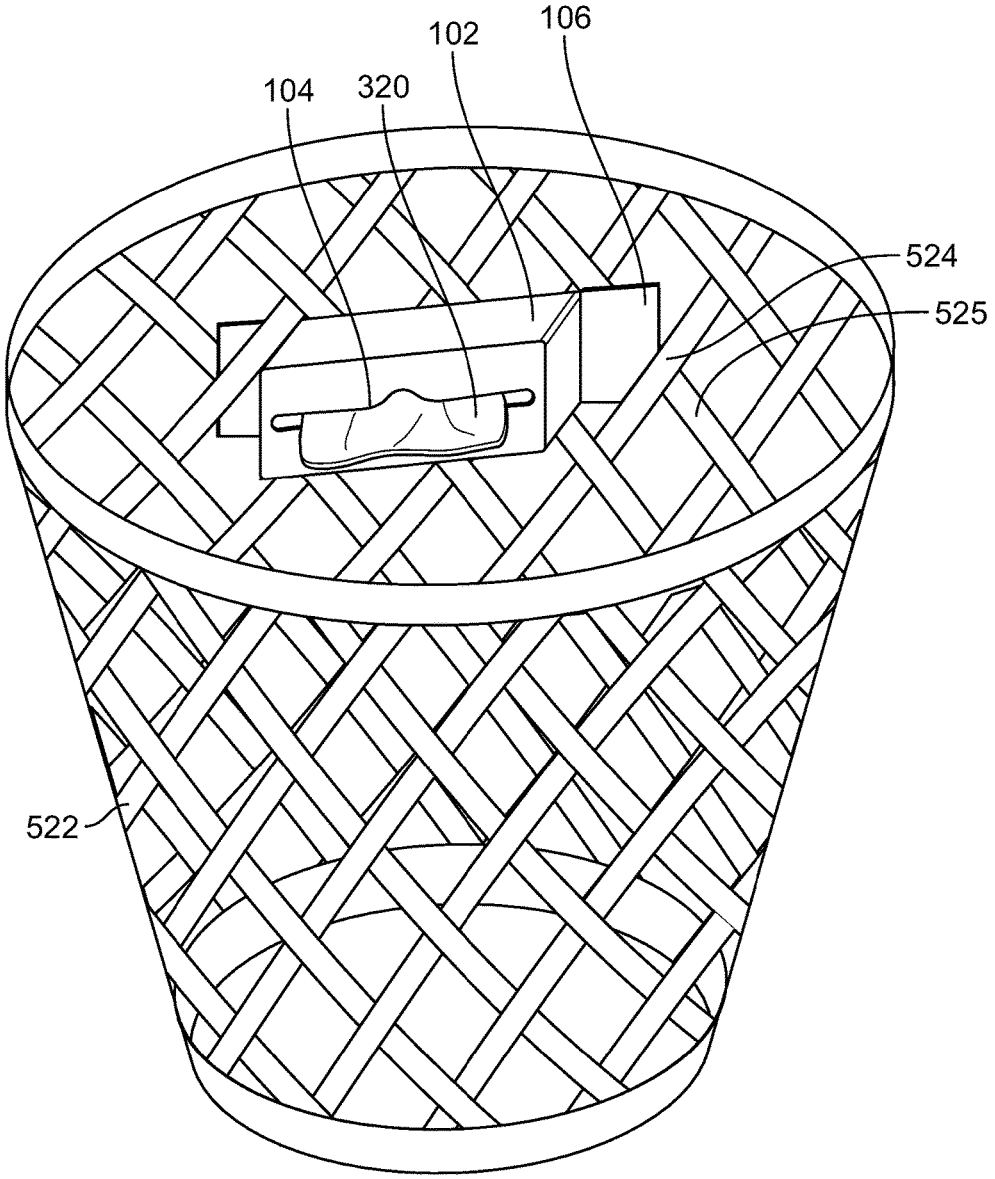
FIG. 5 shows a perspective view of apparatus in accordance with the principles of the invention.

FIG. 5 shows dispenser 100 installed into exemplary woven receptacle 522. Flaps 106 are inserted between woven member 524 and woven member 525 of receptacle 522, thereby holding dispenser 100 securely, but releasably, in place. Adhesive (such as adhesive 210 shown in FIG. 2) on a surface of dispenser 100 may also releasably secure dispenser 100, —e.g., to woven member 525. Bag 320 is depicted as having been dispensed from opening 104 of compartment 102 and arranged so as to line receptacle 522.

Figure 6:
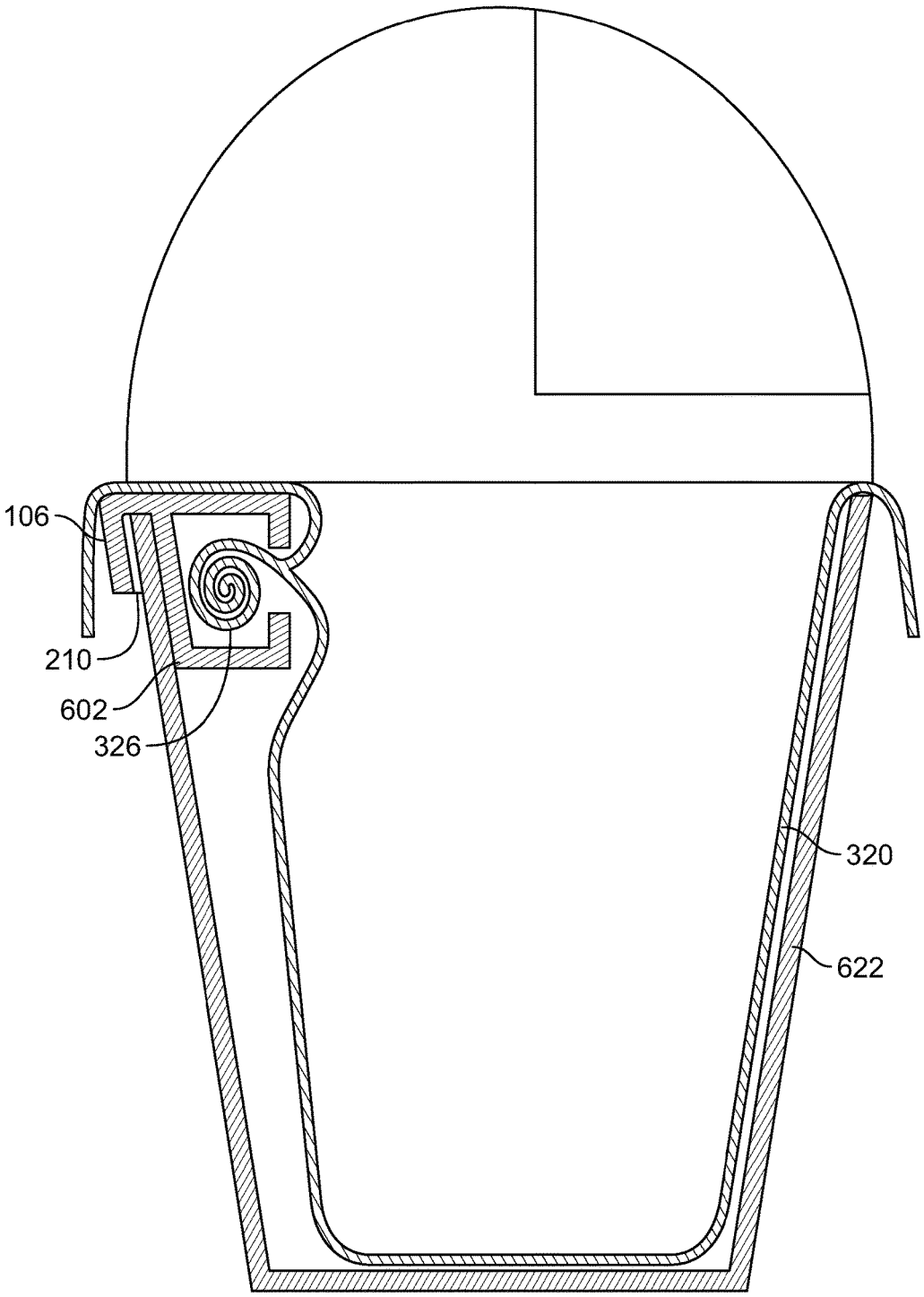
FIG. 6 shows a partial cross-sectional view of apparatus in accordance with the principles of the invention.

FIG. 6 shows an exemplary dispenser (such as dispenser 100 shown in FIG. 1) installed into exemplary receptacle 622. Flap 106 is secured between an upper rim of receptacle 622 and a removable cover of receptacle 622. Alternatively, or additionally, adhesive 210 on flap 106 releasably secures the dispenser to, —e.g., an upper exterior surface of receptacle 622. Bag 320 is depicted as having been dispensed from an opening in compartment 602 of the dispenser and arranged so as to line receptacle 622. Remaining replacement bags forming a roll are contained within receptacle 602. Once bag 320 is full of, —e.g., waste and/or laundry, the cover of receptacle 622 may be removed and bag 320 may be lifted up and out of an upper opening of receptacle 622. As bag 320 is lifted up and out of receptacle 622, one of replacement bags 326, is automatically dragged out from compartment by a releasable connecting region between the one of the replacement bags and bag 320. Upon disconnecting the connecting region, —e.g. by tearing along perforations therein, the one replacement bag may be easily opened and used to line receptacle 622.

Thus, apparatus and methods for optimizing replacement of a disposable bag in a receptacle, by reliably securing a dispenser at the bottom of the receptacle, have been provided. Persons skilled in the art will appreciate that the present invention can be practiced by other than the described embodiments, which are presented for purposes of illustration rather than of limitation.

The present invention is further exemplified by specific embodiments that follow.

What is claimed is:

1. A receptacle-liner dispenser for dispensing disposable liners, the dispenser comprising:
- a liner holder including:
  - one or more walls defining an interior configured for storing the liners; and
  - a dispensing region configured for providing a passageway between the interior and an exterior of the holder; and
- one or more tabs projecting exteriorly from the holder, the tabs configured to perform a releasable securing of the dispenser to a surface;
- wherein:
- a first wall defining the interior includes the dispensing region; and
- the tabs project from a second wall, the second wall opposite the first wall; and
- in an unassembled state:
  - assembly of the dispenser comprises folding the dispenser along one or more creases; and
  - the tabs are configured to be releasably held in place by two side closure flaps.

2. The dispenser of claim 1 wherein the dispensing region includes a slot dimensioned to facilitate sequential dispensing of the liners from the interior.

3. The dispenser of claim 1 wherein, in a pre-dispensing state, the dispensing region includes perforations configured to be opened into a slot dimensioned to facilitate sequential dispensing of the liners from the interior.

4. The dispenser of claim 1 wherein the tabs project from a section of the holder disposed opposite the dispensing region.

5. The dispenser of claim 1, wherein the unassembled state, the tabs are configured to be folded under the side closure flaps.

6. The dispenser of claim 5 wherein the tabs may be unfolded for installation into a receptacle.

7. The dispenser of embodiment claim 1, further comprising an adhesive configured to releasably adhere to the surface, the adhesive disposed exteriorly to the walls and opposite the dispensing region.

8. The dispenser of claim 7 wherein the adhesive extends along a portion of the tabs.

9. The dispenser of claim 1 wherein the securing includes adhering with an adhesive configured to releasably adhere to the surface.

10. The dispenser of claim 1 wherein the surface includes a surface of a receptacle.

11. The dispenser of claim 1 wherein the securing includes a sliding of one or more of the tabs into a recess.

12. The dispenser of claim 1 wherein the recess is defined within a section of a receptacle.

13. The dispenser of claim 12 wherein the section of the receptacle includes a bottom of the receptacle.

14. The dispenser of claim 12 wherein:
- the section includes a woven portion; and
- the recess is defined by the woven portion.

15. A receptacle-liner dispenser comprising:
- a plurality of disposable receptacle-liners, the liners serially connected by one or more inter-liner portions configured to disjoin in response to application of a force, so as to separate one liner from the next;
- a compartment for storing the liners, the compartment including:
  - one or more walls defining an interior configured for storing the liners; and
  - a dispensing region configured to facilitate dispensing the liners; and
- one or more tabs projecting outwardly from the compartment, the tabs configured to perform a releasable securing of the dispenser to a surface;
- wherein:
- the securing includes a sliding of one or more of the tabs into a recess;
- the recess is defined within a section of a receptacle;
- the section includes a woven portion; and
- the recess is defined by the woven portion.

16. The dispenser of claim 15 wherein the inter-liner portions define perforations between serially adjoined liners.

17. A bag dispenser for dispensing bags, the dispenser comprising:
- a bag holder including:
  - one or more walls defining an interior configured for storing the bags; and
  - a dispensing region configured for providing passageway between the interior and an exterior of the holder; and
- one or more wings projecting exteriorly from the holder, the wings configured to perform a releasable securing of the dispenser to a surface;
- wherein:
- the securing includes a sliding of one or more of the wings into a recess;
- the recess is defined within a section of a receptacle;
- the section includes a woven portion; and
- the recess is defined by the woven portion.

18. The dispenser of claim 17 wherein:
- the surface includes an interior surface of a receptacle; and
- the securing includes a releasable attaching of the wings to the surface.

19. The dispenser of claim 17 wherein:
- the wings include adhesive; and
- the securing includes an adhering of the dispenser to the surface via the adhesive.

20. A waste management kit for disposing of waste, the kit comprising:
- a plurality of disposable receptacle-liners, the liners serially connected by one or more inter-liner portions configured to disjoin in response to application of a force, so as to separate one liner from the next;
- a receptacle-liner dispenser including:
  - a compartment for storing the liners, the compartment including:
    - one or more walls defining an interior configured for storing the liners; and a dispensing region configured to accommodate dispensing the liners; and one or more tabs projecting exteriorly from the compartment wherein:

a first wall defining the interior includes the dispensing region; and the tabs project from a second wall, the second wall opposite the first wall;

in an unassembled state, assembly of the dispenser comprises folding the dispenser along one or more creases; and in the unassemvled state, the tabs are configured to be releasably held in place by two side closure flaps; and a waste receptacle including:

a top end configured to receive the waste; and an interior bottom end including one or more retaining members configured to releasably hold the dispenser.

21. The kit of claim 20 wherein the retaining members define one or more recesses configured to receive the tabs.

22. The kit of claim 20 wherein the ret aining members are configured to securely hold the tabs.

23. The kit of claim 20 wherein the inter-liner portions define perforations between serially adjoined liners.

* * * * *